US005122772A

United States Patent [19]

Shimamoto et al.

[11] Patent Number: 5,122,772

[45] Date of Patent: Jun. 16, 1992

[54] SUPERCONDUCTIVE COIL ASSEMBLY

[75] Inventors: Susuma Shimamoto; Hiroshi Tsuji, both of Tokai; Toshinari Ando, Katsuta; Masataka Nishi, Mito; Masamitsu Naganuma, Yokohama, all of Japan

[73] Assignees: Japan Atomic Energy Research Institute, Tokyo; Kabushiki Kaisha Toshiba, Kawasaki, both of Japan

[21] Appl. No.: 684,502

[22] Filed: Apr. 15, 1991

Related U.S. Application Data

[63] Continuation of Ser. No. 289,270, Dec. 23, 1988, abandoned.

[30] Foreign Application Priority Data

Dec. 26, 1987 [JP] Japan ..... 62-330533

[51] Int. Cl.[5] ..... H01F 27/08; H01F 27/30

[52] U.S. Cl. ..... 336/55; 174/15.5; 335/216; 336/DIG. 1; 505/879; 505/880

[58] Field of Search ..... 174/15.5, 125.1; 335/216; 336/DIG. 1, 55, 57, 58; 505/879, 880, 884, 886

[56] References Cited

U.S. PATENT DOCUMENTS

| | | | |
|---|---|---|---|
| 3,527,873 | 9/1970 | Brechna et al. | 335/216 X |
| 3,639,672 | 2/1972 | Kafka | 174/15.5 |
| 4,079,187 | 3/1978 | Fillunger et al. | 174/125.1 X |
| 4,277,768 | 7/1981 | Burgeson et al. | 336/DIG. 1 X |
| 4,277,769 | 7/1981 | Hieronymus | 335/216 |
| 4,333,228 | 6/1982 | Koch | 335/216 |
| 4,336,420 | 6/1982 | Benz | 174/15.5 X |
| 4,454,380 | 6/1984 | Turowski | 174/125.1 |
| 4,482,878 | 11/1984 | Burgeson et al. | 335/216 |
| 4,568,900 | 2/1986 | Agatsuma et al. | 336/DIG. 1 X |

FOREIGN PATENT DOCUMENTS

| | | | |
|---|---|---|---|
| 2602728 | 6/1977 | Fed. Rep. of Germany | 174/15.5 |
| 3506719 | 8/1985 | Fed. Rep. of Germany | 174/15.5 |
| 55-29135 | 3/1980 | Japan | 335/216 |
| 64-54713 | 3/1989 | Japan | 335/216 |

OTHER PUBLICATIONS

Parmer, J. F.; Baldt, R. W.; Agarwal, K. L.; Sutton, R. A.; Ligett, M. W.; Mirror Advanced Reactor Superconducting Magnet Set Design. In: Nuclear Engineering and Design/Fusion 3, (1986), pp. 151-172.

IEEE Transactions on Magnetics, vol. 24, No. 2, "The Selection of a 30KA Ohmic Hearing Coil Conductor"; M. O. Hoeming et al. (1988).

IEEE Transactions on Magnetics, vol. 24, No. 2, "Magnet Technology for the Engineering Test Reactor"; C. D. Henning, J. R. Miller (1988).

*Primary Examiner*—Thomas J. Kozma

*Attorney, Agent, or Firm*—Oblon, Spivak, McClelland, Maier & Neustadt

[57] ABSTRACT

In a superconductive coil assembly, superconductive wires are extended in a sheath tube which also defines a passage for allowing a liquid helium to pass therethrough. Sheath tube is housed in reinforcing vessel which comprises a pair of vessel segments and welded to each other. Reinforcing vessel is enclosed by a turn insulation and a earth insulation.

12 Claims, 8 Drawing Sheets

SUPERCONDUCTIVE COIL ASSEMBLY

This application is a continuation of application Ser. No. 07/289,270 , filed on Dec. 23, 1988, now abandoned.

BACKGROUND OF THE INVENTION

1. Field of the Invention

The present invention relates to a superconductive coil assembly of the internal cooling type and more particularly, it relates to an improvement of the reinforcing vessel for the superconductive coil assembly.

2. Description of the Related Art

The forcedly cooled superconductive coil assembly of the internal cooling type is incorporated into the magnetic confinement fusion apparatus as the one such as Troidal and Poloidal coils to which a large current is supplied. FIG. 1 shows the conventional superconductive coil assembly of this type. Plural sheath tubes 1 each having a rectangular section and a hollow portion through which superconductive wires 2 are inserted and which serves as passage 3 for allowing supercritical helium to flow therethrough are prepared. Insulating layer 4 is formed on the outer surface of each of sheath tubes 1. These sheath tubes 1 are bundled and enclosed by insulating layer 5. In the case of this coil assembly, sheath tubes 1 serve as boundaries against the pressure of supercritical helium. Even when superconductivity is lost or superconductive coils are quenched to raise pressure to a great extent in sheath tube 1, sheath tube 1 serves to accommodate this pressure. Further, it serves to support matters such as superconductive wires 2 relative to electromagnetic force generated when current flowing through the superconductive matters electromagnetically interferes with the matters. It also serves to support the superconductive matters relative to magnetic field caused by the superconductive matters. Therefore, the superconductive coil assembly is held stable by sheath tube 1.

When a large current is intended to flow through superconductive wires 2 as seen in the case of the Toroidal or Poloidal coil in the superconductive coil assembly having the above-described arrangement, the sectional area of superconductive wire 2 is set large and pressure in sheath tube 1 is raised to a substantially large value because of quenching. In order to sufficiently withstand this inner pressure, therefore, it is needed that the wall of sheath tube 1 is made thick. When the wall of sheath tube 1 is made thick, however, the shaping of sheath tube 1 at the process of making sheath tube 1 rectangular and winding it in a spiral in the course of producing the superconductive coil assembly becomes extremely difficult. In addition, undesirable force may be added to superconductive wires 2 to break them while sheath tube 1 is being shaped. It is sometimes seen that sheath tube 1 is deformed like a trapezoid, as shown in FIG. 2, by bending pressure added to sheath tube 1 while sheath tube 1 is being shaped like a spiral. When sheath tube 1 is deformed like this, it is difficult to produce the coil assembly of sufficiently high accuracy. In addition, there is a fear that insulating layer 4 by which the outer surface of sheath tube 1 is wrapped is broken by this deformation of tube 1. When insulating layer 4 is not broken but electromagnetic force acts on sheath tube 1, adjacent sheath tubes 1 are not plane-contacted but point-or part-contacted with each other, thereby making it likely to lose insulation. When the wall of sheath tube 1 is thick, the quantity of heat caused at the time of air-tightly welding sheath tube 1 becomes larger and larger as the wall of sheath tube 1 is made thicker and thicker, thereby causing superconductive wires 2 to be broken.

As described above, the wall of sheath tube 1 is made thick in the case of the conventional superconductive coil assembly. Therefore, the shaping of sheath tube 1 in a coil becomes difficult and the deforming thereof is likely to be caused. The superconductive wires are broken and the dimensional accuracy of the superconductive coil assembly is reduced. Insulation is likely to be lost because the insulation layer for insulating sheath tube 1 from the other adjacent ones is damaged. The superconductive wires may be broken by the increase of heat quantity created at the time of welding the sheath tube.

SUMMARY OF THE INVENTION

The object of the present invention is to provide a superconductive coil assembly, high in reliability, capable of easily shaping the sheath tube, preventing the sheath tube from being deformed, enhancing the dimensional accuracy of the assembly and preventing the superconductive wires and insulating layer from being damaged.

According to the present invention, there is provided a superconductive coil assembly comprising superconductive coil wires; sheath tubes each having a hollow portion through which the superconductive coil wires extend and which serves as a passage for allowing a cooling medium to flow therethrough; reinforcing vessels each serving to reinforce the sheath tube and comprising a vessel segment extended in a spiral and provided with a groove and elongated faces formed in that direction in which the vessel segment extends, and a member mounted on the elongated faces of the vessel segment to close the groove and welded together with the vessel segment to form the reinforcing vessel; and an insulating member for wrapping the outer surface of the reinforcing vessel.

According to the present invention, there is provided a method of making a superconductive coil assembly comprising a process of shaping sheath tubes in a spiral, each of said sheath tubes having a hollow portion through which superconductive coil wires extend and which serves as a passage for allowing a cooling medium to flow therethrough; a process of cutting a metal block to form a vessel segment extended in a spiral and provided with a groove and elongated faces formed in that direction in which the vessel segment extends; a process of preparing a member for closing the groove of the vessel segment; a process of locating the spiral sheath tube in the groove of the vessel segment, mounting the closing member on the elongated faces of the vessel segment and welding them together to form a reinforcing vessel; and a process of wrapping the outer surface of the reinforcing vessel by an insulating member.

DETAILED DESCRIPTION OF THE PREFERRED EMBODIMENT

Figure 1:
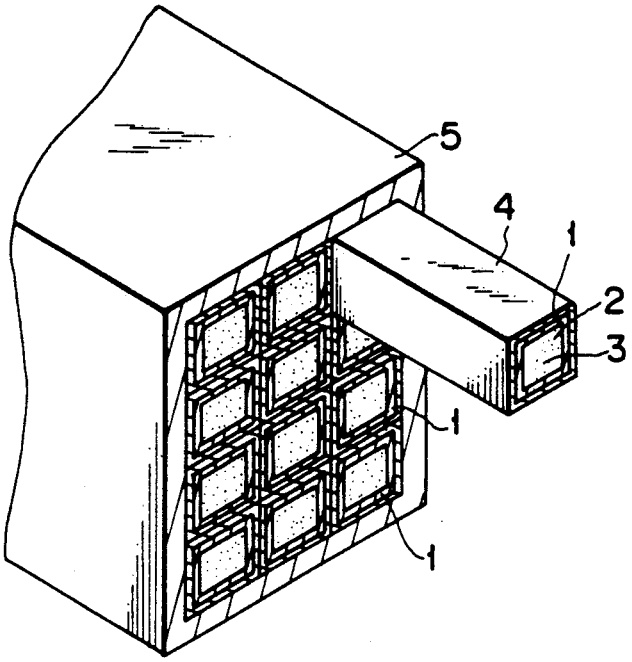
(PRIOR ART) FIG. 1
FIG. 1 is a perspective view showing the sectional construction of the conventional superconductive coil assembly.
Figure 2:
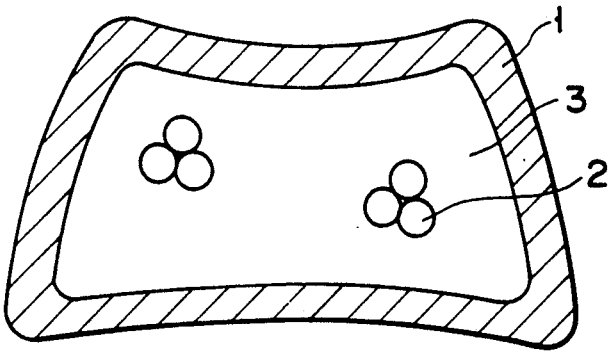
(PRIOR ART) FIG. 2
FIG. 2 is a sectional view showing a sheath tube deformed, said sheath tube being incorporated into the superconductive coil assembly shown in FIG. 1.
Figure 3:
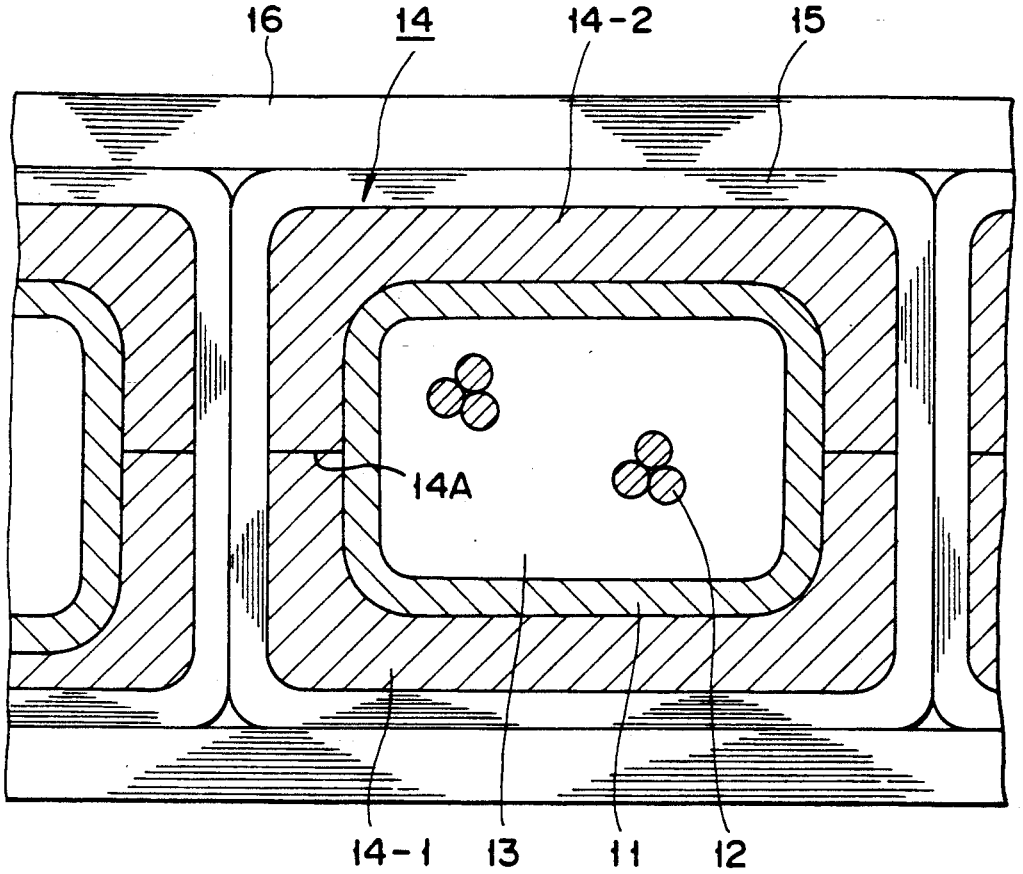
FIG. 3 is a sectional view showing an example of the superconductive coil assembly according to the present invention.
Figure 4:
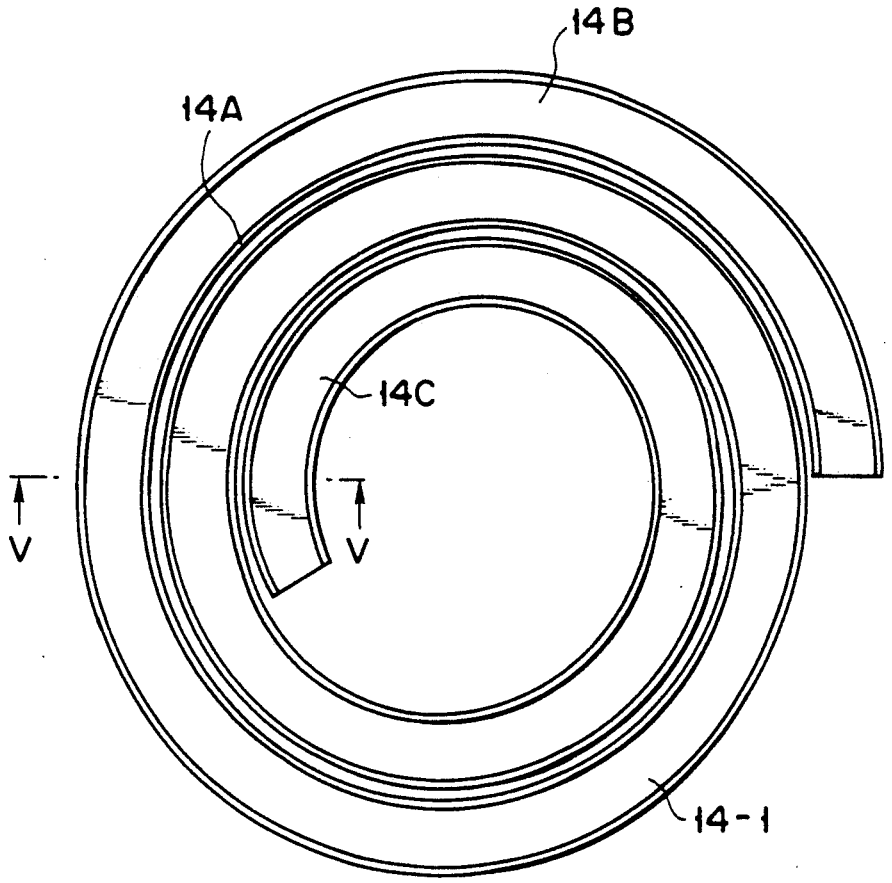
FIG. 4 is a plan showing a reinforcing vessel employed by the superconductive coil assembly in FIG. 3.
Figure 5:
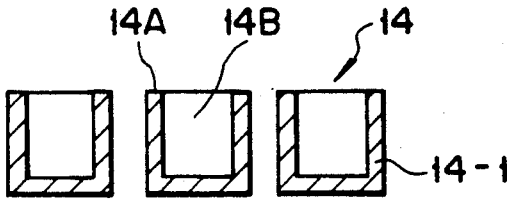
FIG. 5 is a sectional view taken along a line A—A in FIG. 4.

FIG. 3 shows an example of the superconductive coil assembly according to the present invention. Superconductive wires 12 are inserted and extended in the hollow portion of sheath tube 11 which has a comparatively thin wall and a rectangular section, and the remaining space in the hollow portion of sheath tube 11 serves as a passage 13 through which a cooling medium such as supercritical helium, for example, flows along superconductive wires 12. Sheath tube 11 is housed in reinforcing vessel 14 which comprises a pair of vessel segments 14-1 and 14-2 welded integral to each other at their elongated faces 14A and each of vessel segments 14-1 and 14-2 has a substantially U-shaped cross section. As shown in FIG. 4, each of vessel segments 14-1 and 14-2 is formed like a spiral and as shown in FIG. 4, it has elongated faces 14A and groove 14B in which sheath tube 11 is housed. Reinforcing vessel 14 is enclosed by a layer of turn insulation 15 which serves to insulate the reinforcing vessel 14 from the others and the product thus made is further enclosed by a layer of earth insulation 16, which serves to insulate the product from the ground. The turn insulation 15 and the earth insulation 16 are impregnated with an resin in a container to complete the superconductive coil assembly.

Figure 6A:
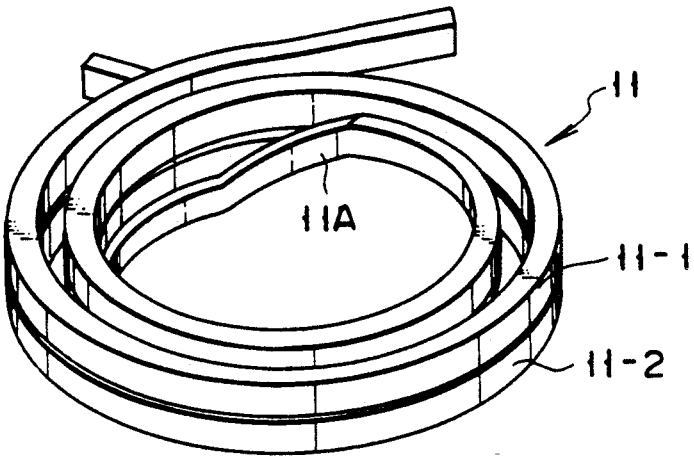
FIGS. 6A through 6H show processes of making the superconductive coil assembly shown in FIG. 3.
Figure 6B:
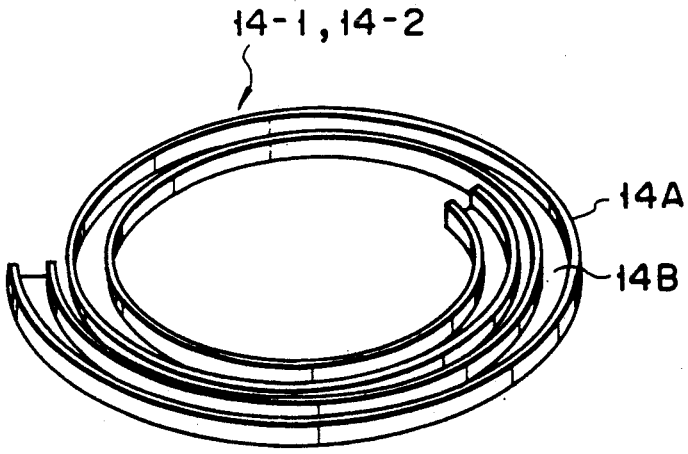
Figure 6C:
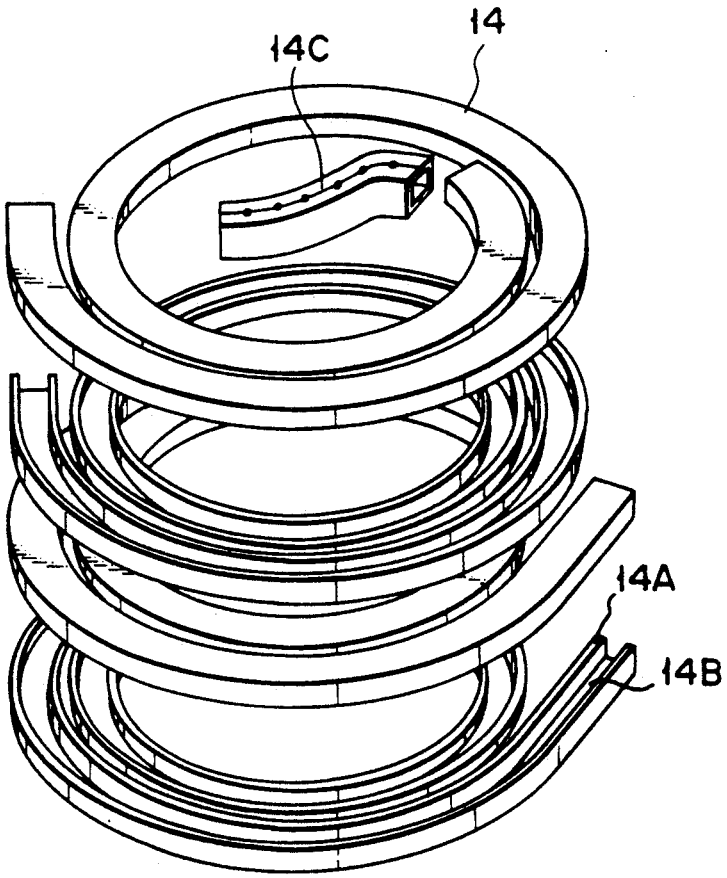
Figure 6D:
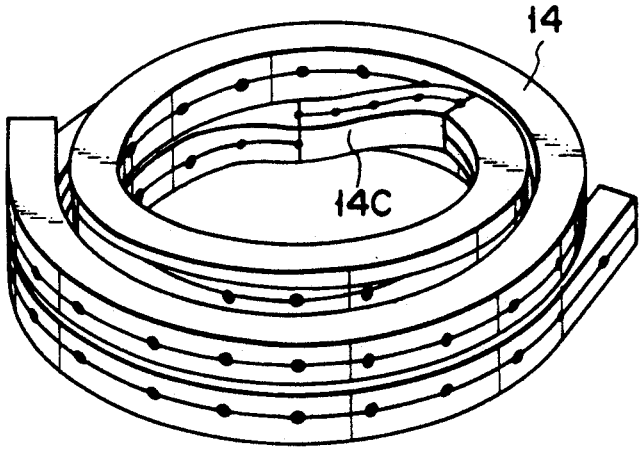
Figure 6E:
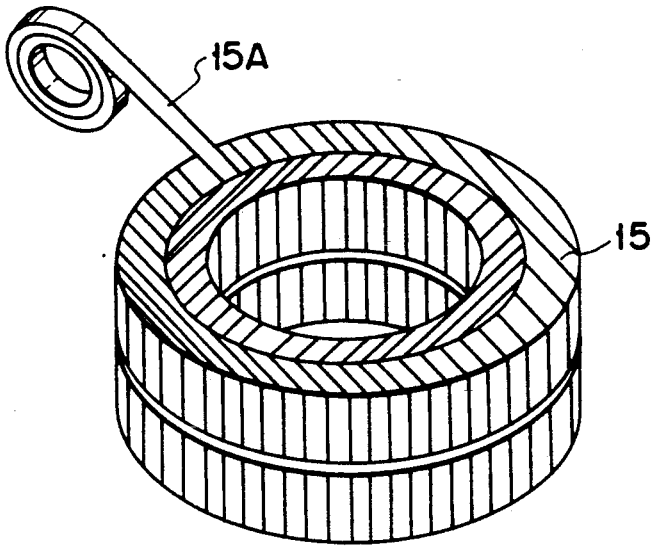
Figure 6F:
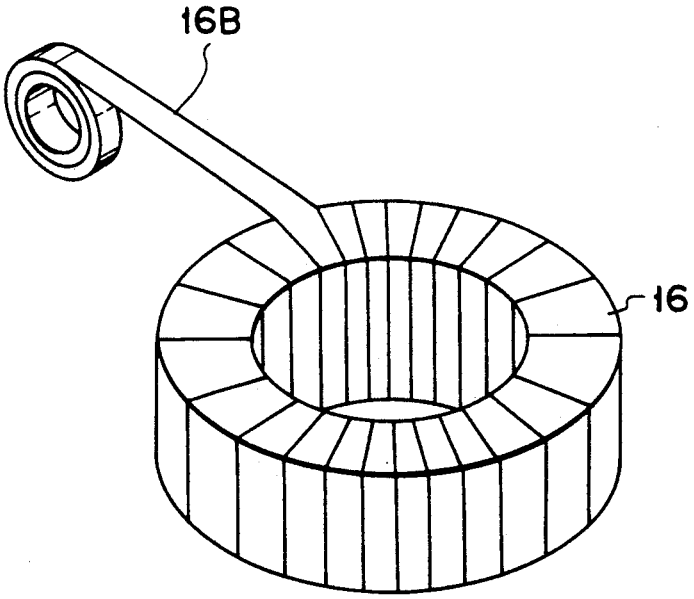
Figure 6G:
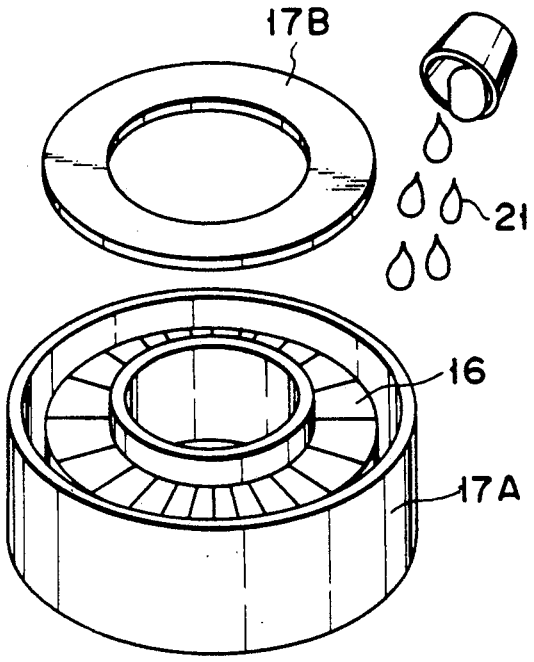
Figure 6H:
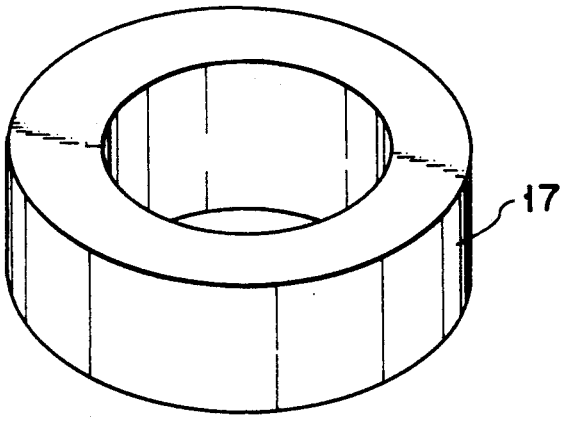

A method of manufacturing the superconductive coil assembly will be described with reference to FIGS. 6A through 6H. As shown in FIG. 6A, sheath tubes 11 in which wires 12 made of superconductive material are housed therein are prepared to form a spiral of two layers. Namely, sheath tube 11-1 which serves as the first layer is wound like a spiral and another sheath tube 11-2 which serves as the second layer and which is connected to the innermost end of sheath tube 11-1 at its innermost end to from continuous section 11A is also wound like a spiral in the same direction. This sheath assembly having a spiral construction of two layers is subject to heating process or kept in an atmosphere of 700° C. for 100 hours to add superconductivity to wires 12. A process of making two sets of paired vessel segments 14-1 and 14-2 are arranged independent of but parallel to the process of making the sheath assembly. Each of vessel segments 14-1 and 14-2 is made by cutting a metal block made of stainless steel, for example, to form a spiral, same as that of sheath tube 11, and further cutting it to form groove 14A and elongated faces 14B, as shown in FIG. 6B. The innermost end of vessel segment 14-1 is coupled to a pair of coupling units 14C each having a substantially U-shaped cross section, as shown in FIG. 6C, in which continuous section 11A formed between first and second layers 11-1 and 11-2 of the sheath assembly is received and to which inner most end of vessel segment 14-2 is coupled. When sheath tubes 11 and two sets of paired vessel segments 14-1 and 14-2 are made, first layer sheath tube 11-1 is connected to second layer sheath tube 11-2 at their innermost ends to form continuous section 11A. Second layer sheath tube 11-2 is then passed through center space of vessel segment 14-1, positioning continuous section 11C at the center space and arranging first and second layer sheath tubes in grooves 14A of two vessel segments 14-1, as shown in FIG. 6C. Two other vessel segments 14-2 are then placed on those two vessel segments 14-1, respectively, which have housed first and second layer sheath tubes 11-1 and 11-2, with their elongated faces 14A contacted. Continuous section 11A is received in coupling units 14C welded each other and ends of coupling units 14C is welded to the inner most end of paired vessel segments 14-1 and 14-2 so that paired vessel segments 14-1 and 14-2 are continously extended through coupling units 14C in the center space. Paired vessel segments 14-1 and 14-2 have a large size and they are made flexible as a whole. This allows a part of spiral to be lifted from the other, as shown in FIG. 6D. Therefore, paired vessel segments 14-1 and 14-2 can be welded along the inner and outer rims of their end faces, holding a part of their spiral lifted from the other. Paired vessel segments 14-1 and 14-2 are thus made integral to each other and two reinforcing vessels 14 are formed, as shown in FIG. 6D. When two reinforcing vessels 14 are finished, each of them is wrapped by insulation tape 15A to form turn insulation 15 which insulates the one from the other as well as to insulate those portions of each which are adjacent to each other, as shown in FIG. 6E. Two reinforcing vessels 14 thus insulated are further wrapped on the outer face of them by insulation tape 16B, as shown in FIG. 6F, to form earth insulation 16 for insulating them from outside. The reinforcing vessels 14 having insulation layer 15 is then received in insulation container, as shown in FIG. 6G and container 17A is filled with epoxy resin and is closed by cap 17B so that turn and earth insulations 15, 16 are impregnated with the epoxy resin. Thus, a finished superconductive coil assembly 17 shown in FIG. 6H is taken out from the container 17B.

According to the above-described superconductive coil assembly, reinforcing vessel 14 houses and holds sheath tube 11 therein to reinforce the latter. This enables sheath tube 11 to become durable enough against stress caused by generated electromagnetic force as well as inner pressure caused at the time of quenching process. Sheath tube 11 itself may serve only to hold the cooling medium such as helium air-tightly and its wall can be made thinner. It can be therefore, processed to a spiral without being deformed. In addition, it can be processed with more easiness. Further, undesirable force is not added to the superconductive wires while the sheath tube 11 is being processed., thereby preventing the superconductive wires from being broken. Reinforcing vessel 14 comprises vessel segments each of which is previously machined to a spiral. This enables the superconductive coil assembly to have a higher accuracy in its dimension. The surface of reinforcing vessel 14 can be smoothed by machining and this prevents the insulation layer on the outer surface of reinforcing vessels 14 from being broken. As apparent from the above, the superconductive coil assembly can be used with higher stability and reliability.

Figure 7:
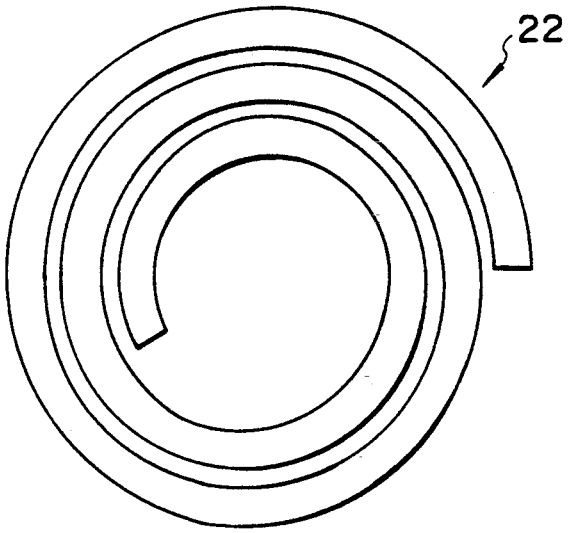
FIGS. 7 and 8 are plans showing a cap and reinforcing vessel segments employed by other examples of the superconductive coil assembly according to the present invention.
Figure 8:
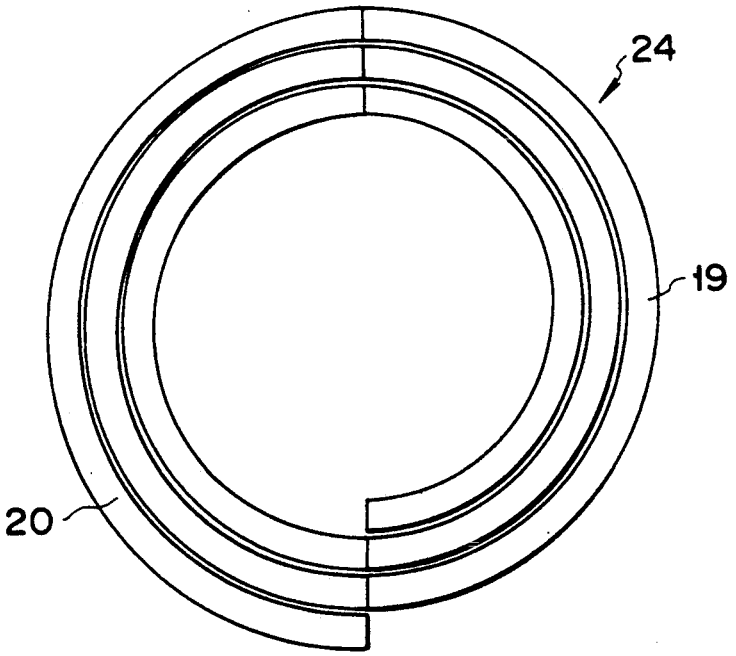

It should be understood that the present invention is not limited to the above-described embodiment but that various changes and modifications can be made without departing from the spirit and scope of the present invention. Although two divided vessel segments each having a U-shaped section have been used to form the reinforcing vessel, it may arranged that groove 14B on vessel segment 14 having a U-shaped section in FIG. 6B is made so deep as to house the whole of sheath tube 11 therein and that spiral cap plate 22 shown in FIG. 7 closes groove 14B. The reinforcing vessel may be formed by casting of stainless steel. The dimensional accuracy of the reinforcing vessel can be made still higher in this case and that of the whole superconductive coil assembly can also be made higher as well. In addition, the surface of this assembly can be smoothed to prevent the insulation layer frcm being damaged. It may be arranged, as shown in FIG. 8, that a plurality of ring-shaped vessel members made concentric to one another by machining process are divided into two or more sector segments 19 and 20 and that sector segments 19 are connected to those 20 which have diameters different from those of sector segment 19 to form a coilshaped reinforcing vessel 24.

According to the superconductive coil assembly of the present invention as described above, the sheath tube can have durability to sufficiently withstand electromagnetic force generated as well as inner pressure caused at the time of quenching process and the wall of the sheath tube can be made thinner thanks to the reinforcing vessel. This enables the sheath tube to be more easily processed without deforming it. In addition, undesirable force is not added to the superconductive wires while the sheath tube is being process, thereby preventing the superconductive wires from being broken. The reinforcing vessel used can be formed to a coil by machining process. This enables the reinforcing vessel to be made as a coil of high dimensional accuracy. This also prevent the insulation layer from being damaged because the reinforcing vessel is smoothed by machining process.

What is claimed is:

1. A superconductive coil assembly comprising superconductive coil wires;

airtight sheath tubes each having a hollow portion through which the superconductive coil wires extend and which serves as a passage for allowing a cooling medium to flow therethrough;

rigid spiral reinforcing vessels, each comprising a spiral first vessel segment provided with a groove and elongated faces to house the sheath tube, and a spiral closing member mounted on the elongated faces of the vessel segment to close the groove, the first vessel segment being made integral to the closing member, holding this member mounted on the elongated faces thereof; and a first insulating member for wrapping the outer surface of the reinforcing vessel to insulate those portions of the vessel which are adjacent to each other.

2. The superconductive coil assembly according to claim 1, further comprising a second insulating member for insulating the reinforcing vessels, which is wrapped around the first insulating member.

3. The superconductive coil assembly according to claim 1, wherein the reinforcing vessel is made of cast metal.

4. The superconductive coil assembly according to claim 1, wherein the reinforcing vessel segment comprises a plurality of rings, which are concentric to one another, and which are divided into at least two sector segments along a line passing through the center of these concentric rings with the sector segments of one group being connected to those of the other group which have diameters different from those of the sector segments of the one group to form a spiral coil.

5. The superconductive coil assembly according to claim 1, wherein the closing member is formed like a spiral strip.

6. The superconductive coil assembly according to claim 1, wherein the closing member is formed as a second vessel segment extending in a spiral and having a substantially U-shaped section and elongated faces and a groove formed in that direction in which the vessel segment extends, and the first and second vessel segments are contacted with each other at their elongated faces to form the reinforcing vessel.

7. A superconductive coil assembly comprising superconductive coil wires;

airtight sheath tubes each having a hollow portion through which the superconductive coil wires extend and which serves as a passage for allowing a cooling medium to flow therethrough;

rigid spiral reinforcing vessels each comprising a pair of first vessel segments each formed like a spiral, substantially U-shaped in section, and provided with a groove and elongated faces to house the sheath tube, said paired first vessel segments being contacted with each other at their elongated faces to form the reinforcing vessel; and a first insulating member for wrapping the outer surface of the reinforcing vessel.

8. The superconductive coil assembly according to claim 7, further comprising a second insulating member for further wrapping the reinforcing vessels, which is wrapped around the first insulating member, to insulate them from outside.

9. The superconductive coil assembly according to claim 7, wherein the reinforcing vessel is made of cast metal.

10. The superconductive coil assembly according to claim 7, wherein at least one of the reinforcing vessels comprises a plurality of rings, which are concentric to one another, and which are divided into at least two sector segments along a line passing through the center of these rings, and the sector segments of one group being connected to those of the other group which have diameters different from those of the sector segments of the one group to form a spiral coil.

11. The superconductive coil assembly according to claim 1, wherein the reinforcing vessel is made of metal and is cut from a block.

12. The superconductive coil assembly according to claim 7, wherein the reinforcing vessel is made of metal and is cut from a block.

* * * * *

UNITED STATES PATENT AND TRADEMARK OFFICE

CERTIFICATE OF CORRECTION

PATENT NO. : 5,122,772

DATED : June 16, 1992

INVENTOR(S) : SUSUMU SHIMAMOTO, ET AL

It is certified that error appears in the above-identified patent and that said Letters Patent is hereby corrected as shown below:

On title page, item [75], change the name of the first inventor to read "Susumu Shimamoto".

In column 1, line 18, change "Troidal" to --Toroidal--.

In column 3, line 6, change "A-A" to --V-V--.

In column 4, line 7, change "11C" to --14C--.

Signed and Sealed this

Fourteenth Day of September, 1993

Bruce Lehman

*Attest:*

BRUCE LEHMAN

*Attesting Officer*

*Commissioner of Patents and Trademarks*